United States Patent [19]

Noville et al.

[11] Patent Number: 5,035,403

[45] Date of Patent: Jul. 30, 1991

[54] APPARATUS FOR COOLING A CYLINDRICAL MEMBER IN LINEAR MOTION

[75] Inventors: Jean-Francois L. Noville, Herstal; Stéphan H. Wilmotte, Chaudfontaine, both of Belgium

[73] Assignee: Centre de Recherches Metallurgiques-Centrum Voor Research in de Metallurgie, Brussels, Belgium

[21] Appl. No.: 426,119

[22] Filed: Oct. 24, 1989

[30] Foreign Application Priority Data

Oct. 24, 1988 [BE] Belgium ..... 08801224

[51] Int. Cl.[5] ..... B21B 45/02; C21D 1/62

[52] U.S. Cl. ..... 266/114; 266/113

[58] Field of Search ..... 266/114, 113

[56] References Cited

U.S. PATENT DOCUMENTS 4,645,185 2/1987 Sabatini ..... 266/114

*Primary Examiner*—R. Dean

*Assistant Examiner*—Margery S. Phipps

*Attorney, Agent, or Firm*—Fleit, Jacobson, Cohn, Price, Holman & Stern

[57] ABSTRACT

A cooling apparatus for a cylindrical member in linear motion comprises a tubular conduit through which the cylindrical member passes axially, an envelope surrounding the tubular conduit and forming therewith an annular chamber therebetween closed at its ends by an upstream wall and a downstream wall, respectively, cooling agent being introduced into the annular chamber. The tubular conduit is pierced radially by a plurality of a straight passages providing communication between the annular chamber and the internal space in the tubular conduit. These passages are located in planes perpendicular to and axially spaced along the longitudinal axis of the tubular conduit and are equally circumferentially spaced within each plane and angularly displaced with respect to the passages in the adjacent planes. Cooling agent passes through the passages radially inwardly and is drained from the internal space of the tubular conduit.

17 Claims, 3 Drawing Sheets

APPARATUS FOR COOLING A CYLINDRICAL MEMBER IN LINEAR MOTION

BACKGROUND OF THE INVENTION

1. Field of Invention

This invention relates to apparatus for cooling a cylindrical member in linear motion whereby the member is cooled homogeneously.

By a cylindrical member in linear motion is meant a product of elongated shape, for example a bar or a tube, which is moving along its longitudinal axis.

Apparatus according to the invention is particularly intended for cooling a steel product from the rolling temperature at the outlet from a rolling mill. It can nevertheless also be used for cooling after any forming or heat treatment operation.

2. Description of Prior Art

Apparatus for cooling a cylindrical steel member in linear motion delivered from a rolling mill, which apparatus uses in particular rings of nozzles or circumferential slots to distribute a cooling agent over the surface of the member, has been known for a long time. The cooling provided by such means is in general not sufficiently fast and homogeneous over both the perimeter of the cylindrical member in linear motion and its length, particularly where this cooling governs certain final properties of the member. The properties in question are linked with the production of an appropriate structure, for example a hardened and self-annealed surface layer, or again a fine grain ferritic structure, in the case of steel.

SUMMARY OF THE INVENTION

This invention provides means whereby a cylindrical member in linear motion may be cooled without the aforementioned disadvantages of insufficient speed and homogeneity, thus providing the cylindrical member with the desired structure and properties.

The invention provides apparatus for the cooling of a cylindrical member in linear motion by means of a cooling agent, comprising a straight tubular conduit which is open at both ends within which the linearly moving cylindrical member which is to be cooled passes, an envelope encircling the tubular conduit and forming an annular chamber therewith, the annular chamber being closed at both ends by an upstream wall and a downstream wall respectively, means for introducing the cooling agent into the annular chamber, the tubular conduit being pierced by a plurality of straight, preferably radial, passages which provide communication between the annular chamber and the internal space of the tubular conduit, the passages being arranged in plane rings perpendicular to the longitudinal axis of the tubular conduit, and equidistant within each of the said rings, in that one ring is displaced angularly with respect to the adjacent ring, and means for draining the cooling agent from the internal space of the tubular conduit.

In accordance with a particular embodiment of the invention the radial passages are arranged in one or several groups of at least three equidistant rings. Within each group each ring has preferably the same number of passages, with the consequence that the equal spacing of the passages within a ring is identical for all the rings within one group. Finally the angle of displacement between two adjacent rings of passages is advantageously the same for all the rings in one group. The means for introducing cooling agent into the annular chamber may be of the usual kind. They may for example consist of a feed conduit connected to a source of cooling agent and opening laterally into the annular chamber. In general this feed conduit opens into the annular chamber in a radial manner.

Within the annular chamber a deflector or baffle is advantageously provided at the opening of the feed conduit. Such a deflector prevents any direct effect by the cooling agent issuing from the feed conduit on the flow of the cooling agent within the radial passages opposite the opening of the feed conduit.

The means for draining cooling agent comprises at least one transverse passage located at the upstream end of the tubular conduit. A plurality of these transverse passages are preferably spaced out uniformly along the periphery of the tubular conduit. Yet more advantageously these transverse passages meet in a continuous peripheral slot which connects the internal space of the tubular conduit and external means for receiving the cooling agent.

The transverse passage may be formed between the wall closing off the upstream end of the annular chamber and an outer annular plate located at some distance upstream of this wall and extending radially beyond at least part of the entrance opening of the tubular conduit.

The radially inner edge of the annular plate is advantageously profiled to have a funnel shape so as to act as a guide when the linearly moving cylindrical moving member which is to be cooled is introduced into the tubular conduit.

In accordance with a useful variant the apparatus according to the invention also includes retention means to prevent the cooling agent from escaping through the inlet and outlet openings for the cylindrical member in the tubular conduit and thus to compel the cooling agent to drain away through the transverse passages or the transverse slot described above.

These retention means may be of a mechanical nature, such as plates pierced with a calibrated opening to provide a passage for the cylindrical member. They may also be of a hydraulic or pneumatic type, such as jets of fluid (liquid or gas) under pressure forming a screen at the inlet and outlet of the tubular conduit.

The detailed description which follows will show other preferred features and advantages of the apparatus according to the invention. This description refers to a preferred embodiment described by way of example and illustrated by the accompanying drawings.

These drawings are only diagrammatical representations of the object of the invention which are provided by way of example only and which are not shown to any particular scale.

In order not to complicate the drawings, components which are not directly necessary for an understanding of the invention, in particular means for assembling the apparatus, have not been illustrated. In order to aid understanding of the description which follows similar or identical members have been indicated by the same reference numbers in all the Figures.

DESCRIPTION OF PREFERRED EMBODIMENTS

Figure 1:
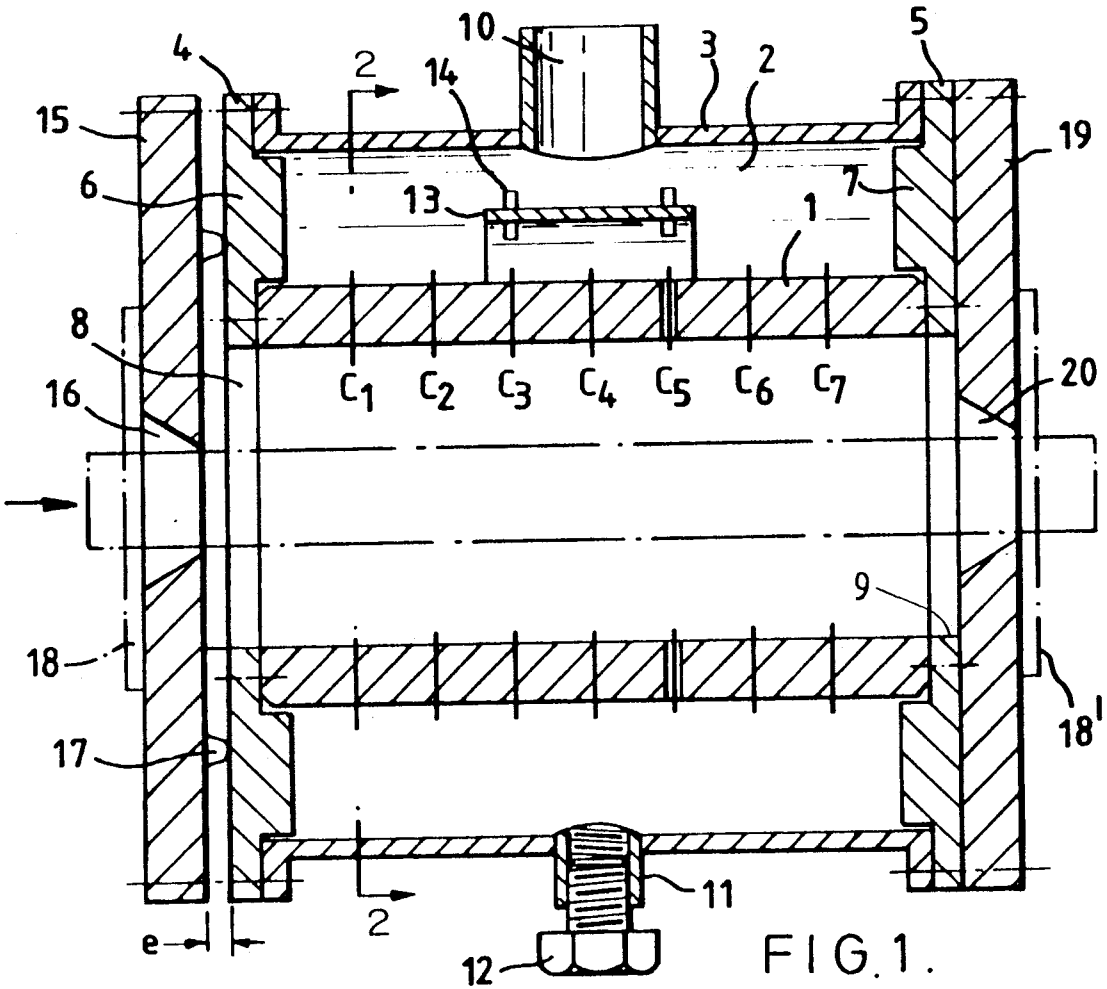
FIG. 1 is a longitudinal cross-sectional view taken along line 1—1 in FIG. 2 through apparatus for cooling a cylindrical member according to the invention.

FIG. 1 shows a longitudinal section through apparatus for cooling a cylindrical member in linear motion. The apparatus includes a tubular conduit 1 through which the cylindrical member which is to be cooled, represented symbolically by a line of unequal dashes, moves. Tubular conduit 1 is surrounded by an annular chamber 2 which is bounded externally by a generally cylindrical envelope 3. Chamber 2 is enclosed at its ends by walls 4, 5 which are provided with centering projections 6, 7. These walls 4, 5 are attached to envelope 3 by means of bolts illustrated diagrammatically by their axes. They are pierced by central openings 8, 9 which are located along an extension of the internal passage within tubular conduit 1. Annular chamber 2 is connected by a feed conduit 10 to a source of cooling agent, which is not shown. It also has an opening 11 which in operation is normally closed off by a plug 12, but which may for example be used to measure the pressure in chamber 2. This opening 11 may also be used for draining and cleaning chamber 2.

Figure 3:
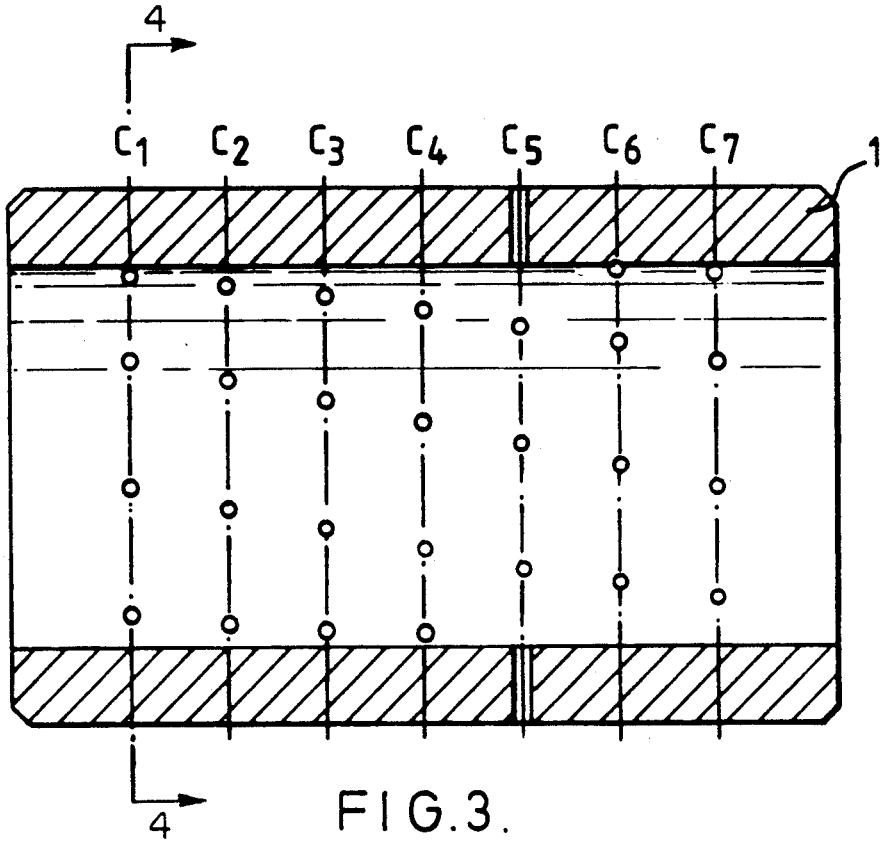
FIG. 3 is a longitudinal cross-sectional view of a tubular conduit pierced with radial passages designed for the cooling apparatus taken along line 3—3 in FIG. 4.
Figure 4:
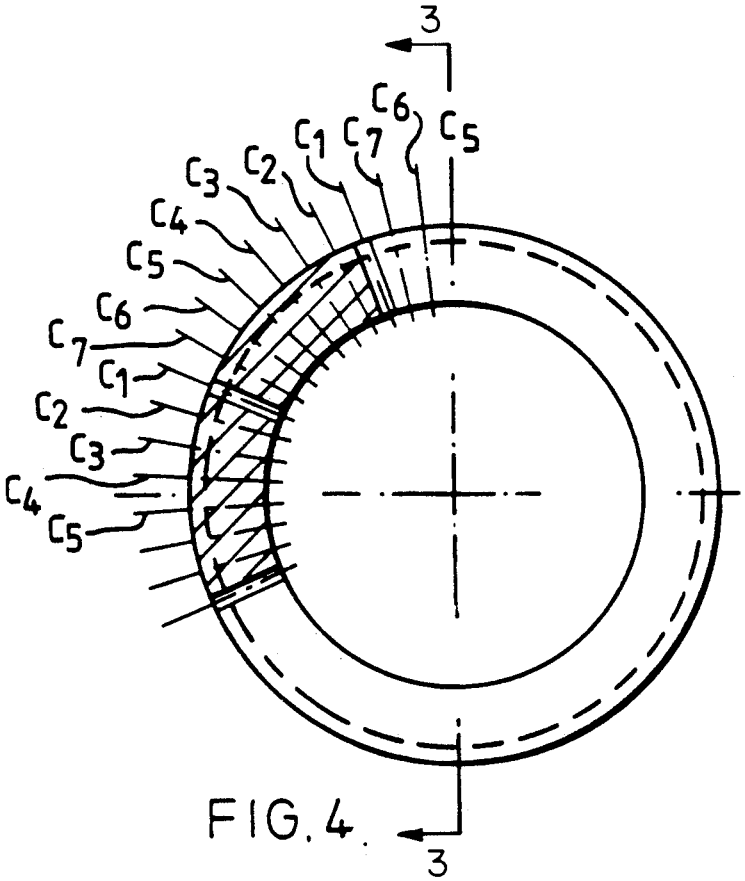
FIG. 4 is a transverse cross-section of the tubular conduit taken along line 4—4 in FIG. 3.

Tubular conduit 1 is pierced by radial passages such as C5, which are arranged in rings, as will better be seen in FIGS. 3 and 4. A deflector or baffle consisting for example of a plate 13 welded to envelope 3 by means of rods 14 is provided facing the opening of feed conduit 10. Plate 13 covers the entrance openings of the radial passages located opposite the outlet opening of feed conduit 10, at a distance. This thus avoids an excessively direct effect by the feed flow on the flow through the aforementioned radial passages and contributes to a more uniform distribution of the cooling agent throughout these radial passages.

An outer plate 15, pierced by a central opening 16, which is provided with a funnel profile to assist in production of the cylindrical member being cooled, is located opposite to and at a distance "e" from upstream wall 4. In its narrowest portion this central opening has a diameter slightly greater than the external diameter of the cylindrical member. It is useful to provide a set of several plates with different opening diameters appropriate to the range of sizes of the cylindrical members which are to be cooled. The "inner" face of this plate 15 is provided with spacers such as lugs 17 which automatically provide the desired spacing "e" between plate 15 and upstream wall 4. Finally plate 15 may also be provided on its "outer" face with a drip plate 18, illustrated symbolically by a line of dashes of different lengths, which is designed to improve the retention of cooling agent.

At the outlet end of the device another outer plate 19 is fitted against downstream wall 5. This is also pierced by a central opening 20 which is profiled to have a funnel shape and has a diameter appropriate to the dimensions of the cylindrical member. If a set of plates 19 is provided then the most suitable plate for the external diameter of the cylindrical member being treated may be used. A drip plate 18' may also finish off the apparatus. The drip plates 18 and 18' are preferably constructed of a flexible material such as silicone.

Figure 2:
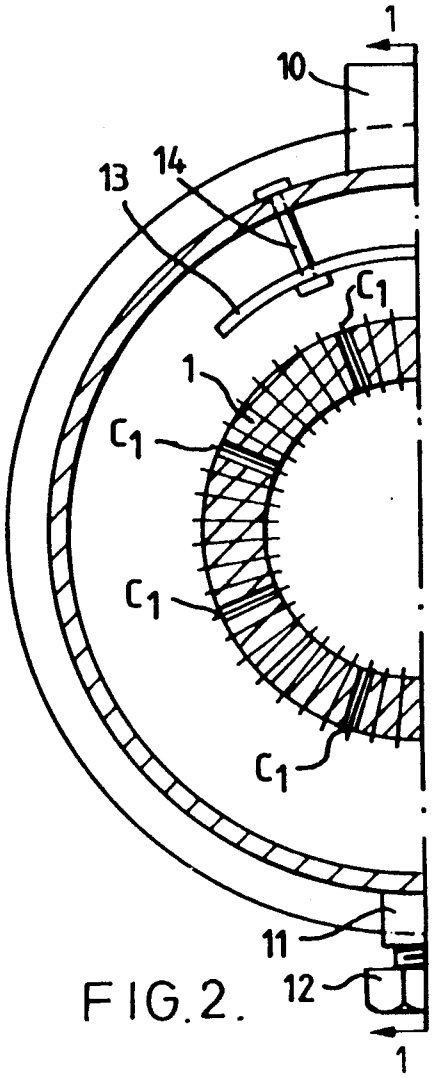
FIG. 2 is a partial view of a transverse cross-section of the cooling apparatus taken along line 2—2 in FIG. 1.

FIG. 2 essentially shows the position of deflector plate 13 and supporting rods 14 with respect to radial passages such as C1 located opposite the opening of feed conduit 10. It also illustrates the layout of a ring of radial passages, in this case passages C1.

FIGS. 3 and 4 illustrate the construction of a tubular conduit intended for the apparatus according to FIG. 1, in longitudinal section and transverse section respectively.

FIG. 3 shows that the radial passages are distributed in rings C1 . . . C7 in planes perpendicular to the axis of tubular conduit 1.

In this example a group of seven rings each of which incorporates eight radial passages at an angular spacing of 45° is shown. It goes without saying that the numbers of these rings and radial passages do not in any way restrict the scope of the invention.

To avoid complicating the drawing only the radial passages occurring in the section planes have been shown by solid lines, namely passages C5 in FIG. 3 and passages C1 in FIG. 4. The other radial passages are merely shown symbolically by their corresponding axes.

The rings for passages C1 to C7, or the planes in which the axes of the passages lie are equidistant in the longitudinal direction and the passages are offset angularly with respect to each other by a constant angle which in this case is 360°/56, two successive radial passages within a given ring being always separated by an angle of 45°. In the longitudinal direction the openings of the radial passages appear as helical lines in the internal and external surfaces respectively of tubular conduit 1.

In general angle of offset between the two successive rings is 360°/(N.n), where N and n represent the number of rings and the number of radial passages in each ring respectively.

It is obvious that tubular conduit 1 may have several successive groups of rings in the longitudinal direction without going beyond the scope of the invention, and the values of N and n may also vary from one group to another.

This being the case, it will be appreciated that the axis of each radial passage describes a generatrix of the cylindrical member upon the cylindrical member in linear motion and that each point on each of these generatrices passes beneath a given number of radial passages. An arrangement of this kind appreciably increases the uniformity of cooling.

Figure 5:
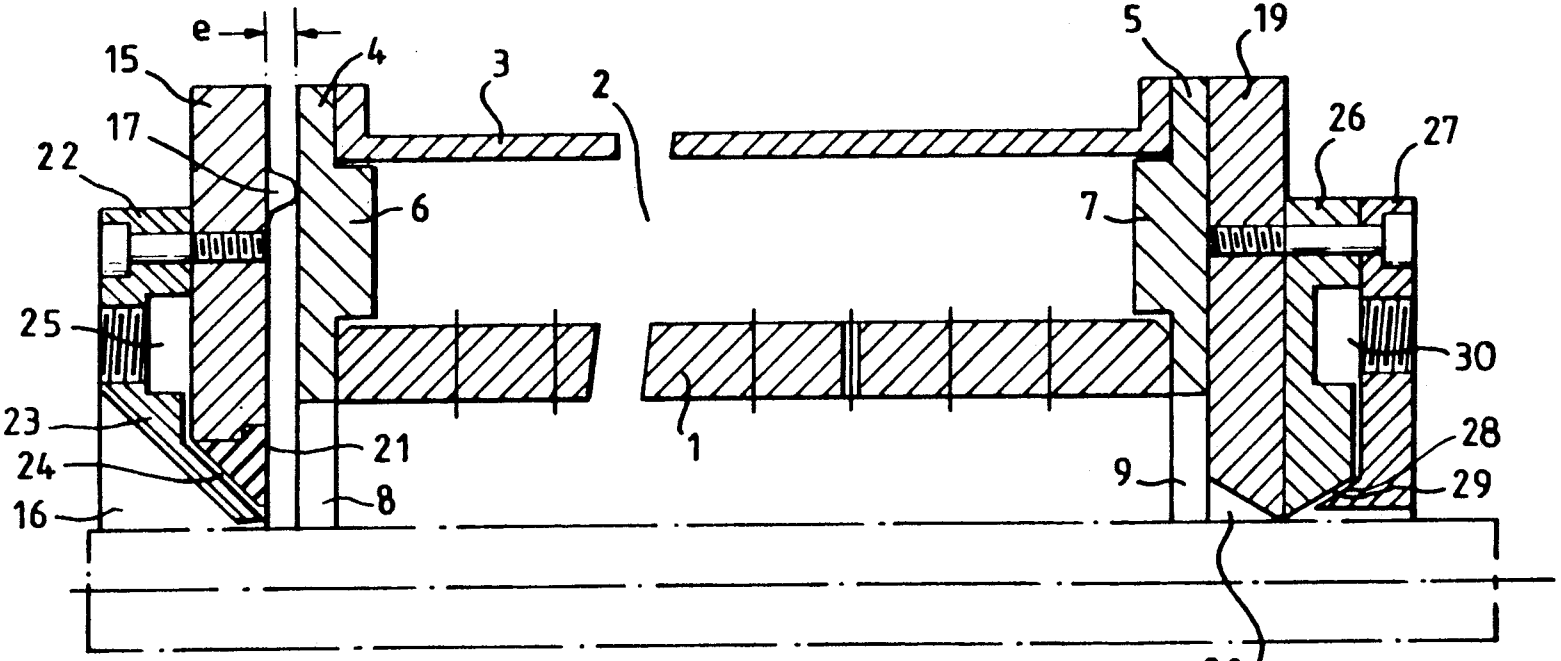
FIG. 5 is a partial longitudinal cross-sectional view of another embodiment intended to provide retaining screens at the inlet and outlet of the cooling apparatus according to the invention.

FIG. 5 illustrates an embodiment with a variant means intended to provide screens for retaining the cooling agent at the inlet and outlet of tubular conduit 1.

In this variant upstream plate 15 is provided at its lower edge with a rebated collar 21 having the profile of a funnel. An annular stirrup 22 with a lip 23, which together with collar 21 forms a slot 24 which is inclined radially inwardly in the direction of movement of the cylindrical member, is placed on the outer face of upstream plate 15. This slot communicates with a distribution cavity 25 made in stirrup 22 and is itself connected to a source of cooling agent, which is not shown. The outer face of lip 23 is given the shape of a funnel and forms an entrance guide for the cylindrical member being cooled. Collar 21 is radially slightly set back with respect to lip 23 so as to avoid any premature engagement with the cylindrical member as it enters.

At the other end of the cooling apparatus, downstream plate 19 bears an annular assembly consisting of a base 26 and a cover 27. Base 26 is applied to plate 19 and its radially inner edge has a diverging profile. Cover 27 ends in a lip 28 which continues, at some distance, the divergent profile of the base. In this way there is formed a slot 29 which is inclined radially inwardly and in a direction opposite to the direction of movement of the cylindrical member and which communicates through a distribution cavity 30 provided in base 26 with a source of cooling agent, which is not shown.

In this assembly the inner extremity of lip 28 is radially slightly set back with respect to the ridge of the convergent profile of downstream plate 19 so as to avoid any undesirable contact with the cylindrical member.

The operation of this cooling apparatus can easily be understood by reference to the drawings and the description relating to them.

Cooling agent, normally water, is introduced into annular chamber 2 via feed conduit 10, from where it flows through radial passages C1 . . . C7 to fill the space between tubular conduit 1 and the cylindrical member being cooled. As a result of the aforesaid retention means the cooling agent then escapes through slot "e" between wall 4 and plate 15, thus setting up a countercurrent circulation which has proved particularly favorable to cooling of the cylindrical member. In addition to this the jets of cooling agent issuing from the radial passages stir up the cooling agent and prevent a warming layer from forming at the surface of the cylindrical member.

When cylindrical members of different diameters have to be cooled, all that is necessary is to change upstream plates 15 and downstream plates 19, which requires a preferably automatic adjustment of the width "e" of the drainage slot so as to ensure that the annular space surrounding the cylindrical member in the guide is sufficiently filled with cooling agent, regardless of the diameter of the cylindrical member.

In this way the same cooling apparatus may he used to treat a large range of diameters of the cylindrical member. To provide an indication, a tubular conduit 1 having an internal diameter of 106 mm can be used to treat cylindrical members having an external diameter between 340 mm and 90 mm.

With a small set of cooling guides each having a specific internal diameter cylindrical members whose external diameter lies between 20 mm and 200 mm can be treated.

By way of example, tubes having an external diameter of 90 mm and a wall thickness of 6.5 mm have been cooled in apparatus in which the tubular conduit has an internal diameter of 106 mm. This conduit had 56 radial passages of 2 mm diameter, distributed in seven rings. The tubes being cooled were of steel containing 0.2% C, 0.25% Si, 1.2% Mn, 0.25% Cr. On entering, their temperature was 900° C. After cooling for 1.4 s with a specific water flow of 60 $l/m^2.s$ under a pressure of 2 bars, a self-annealing temperature of 600° C. was obtained. After cooling the tubes had an elastic limit $R_e$=630 MPa and an ultimate tensile strength of $R_r$=740 MPa.

The invention is obviously not restricted to the forms of the embodiments which have been described and illustrated. The apparatus may be subjected to numerous modifications, in particular as regards the number of radial passages and the means for retaining the cooling agent, without going beyond the scope of the following claims.

We claim:

1. Apparatus for cooling a cylindrical member in linear motion by means of a cooling agent, comprising:

a straight tubular conduit open at both ends and through which the cylindrical member is to be passed;

an envelope means surrounding said tubular conduit in spaced relationship and forming an annular chamber between said tubular conduit and said envelope means;

an upstream end and a downstream end for said chamber with respect to the direction of travel of the cylindrical member;

an upstream wall and a downstream wall closing said upstream end and said downstream end respectively;

means for introducing cooling agent into said annular chamber;

a plurality of substantially straight passages through said tubular conduit providing communication between said annular chamber and the internal space of said tubular conduit, said passages being located substantially in planes perpendicular to and axially spaced along the longitudinal axis of said tubular conduit, said passages being equally spaced circumferentially in each of said planes forming axially spaced rings of passages in said tubular conduit, each said ring of passages having an displacement with respect to a neighboring ring; and means for draining the cooling agent from said internal space of said tubular conduit.

2. The apparatus as claimed in claim 1, wherein:

said passages are oriented substantially radially in said tubular conduit.

3. The apparatus as claimed in claim 1, wherein:

said tubular conduit has at least one group of at least three of said rings of passages and said rings in said at least one group are equidistantly spaced.

4. The apparatus as claimed in claim 3, wherein:

said angular displacement between two adjacent rings of passages is the same for all said rings in said group.

5. The apparatus as claimed in claim 4, wherein:

said angular displacement is equal to 360°/(N.n), where N is the number of rings in said group and n is the number of passages in each ring in said group.

6. The apparatus as claimed in claim 1, and further comprising:

a deflector means within said annular chamber to facilitate uniform distribution of the cooling agent into said passages.

7. The apparatus as claimed in claim 1, wherein:

said tubular conduit has upstream and downstream ends; and said means for draining the cooling agent comprises at least one drain passage located at and communicating with said upstream end of said tubular conduit and extending substantially transversely to the longitudinal axis thereof.

8. The apparatus as claimed in claim 7 wherein:

said at least one drain passage comprises an annular slot.

9. The apparatus as claimed in claim 7, and further comprising:

an external annular plate spaced at a distance upstream of said upstream wall and extending substantially radially and over at least part of said upstream end of said tubular conduit; and said transverse drain passage being disposed between said upstream wall and said external annular plate.

10. The apparatus as claimed in claim 9 wherein:

a plurality of axially extending spacers are provided on said external annular plate and engage against said upstream wall.

11. The apparatus as claimed in claim 10 wherein:

said at least one drain passage comprises an annular slot.

12. The apparatus as claimed in claim 9 and further comprising:

an annular drip plate on the side of said external annular plate opposite to said drain passage; and an opening in said drip plate through which the cylindrical member passes.

13. The apparatus as claimed in claim 9 and further comprising:

a cooling plate on the upstream side of said external annular plate;

an annular channel between said cooling plate and said annular end plate;

a cooling agent inlet through said cooling plate communicating with said annular channel; and a cooling agent outlet slot between said cooling plate and annular end plate extending from said annular channel substantially radially inwardly.

14. The apparatus as claimed in claim 1, and further comprising:

openings at said upstream and downstream ends of said tubular conduit through which the cylindrical member enters and leaves said tubular conduit; and retention means for preventing the cooling agent from escaping through said openings.

15. The apparatus as claimed in claim 14, wherein:

said retention means comprises end plates having respective calibrated openings therethrough.

16. The apparatus as claimed in claim 14, wherein:

said retention means comprise means forming fluid screens at said ends of said tubular conduit.

17. The apparatus as claimed in claim 15 wherein:

said calibrated openings have funnel shaped profiles.

* * * * *